US009681725B2

(12) United States Patent
Roualdes

(10) Patent No.: US 9,681,725 B2
(45) Date of Patent: Jun. 20, 2017

(54) COSMETIC PRODUCT APPLICATOR, ASSOCIATED HEAD AND DEVICE

(75) Inventor: Marine Roualdes, Paris (FR)

(73) Assignee: L'OREAL, Paris (FR)

( * ) Notice: Subject to any disclaimer, the term of this patent is extended or adjusted under 35 U.S.C. 154(b) by 955 days.

(21) Appl. No.: 12/858,109

(22) Filed: Aug. 17, 2010

(65) Prior Publication Data

US 2011/0041863 A1 Feb. 24, 2011

Related U.S. Application Data

(60) Provisional application No. 61/238,708, filed on Sep. 1, 2009.

(30) Foreign Application Priority Data

Aug. 18, 2009 (FR) ..... 09 55703

(51) Int. Cl.

| | |
|---|---|
| ***A45D 19/02*** | (2006.01) |
| ***A45D 40/26*** | (2006.01) |
| ***A46B 9/02*** | (2006.01) |
| ***A45D 19/00*** | (2006.01) |

(52) U.S. Cl.

CPC ..... *A45D 19/02* (2013.01); *A45D 40/262* (2013.01); *A45D 40/265* (2013.01); *A46B 9/021* (2013.01); *A45D 2019/0091* (2013.01); *A46B 2200/106* (2013.01)

(58) Field of Classification Search

CPC .... A45D 19/02; A45D 40/262; A45D 40/265; A45D 2019/0091; A46B 9/021; A46B 2200/106

USPC ..... 132/112–116; 119/603, 604, 625, 632, 119/664, 665

See application file for complete search history.

(56) References Cited

U.S. PATENT DOCUMENTS

| | | | | |
|---|---|---|---|---|
| 1,202,539 | A * | 10/1916 | Landre | 132/116 |
| 2,849,009 | A * | 8/1958 | Heinrich et al. | 132/116 |
| 2,922,425 | A * | 1/1960 | Lerner et al. | 132/212 |
| 5,803,093 | A * | 9/1998 | Romano | 132/116 |
| 2003/0213498 | A1* | 11/2003 | Gueret | 132/218 |
| 2006/0289026 | A1* | 12/2006 | Desmond et al. | 132/142 |
| 2008/0142030 | A1* | 6/2008 | Venere et al. | 132/116 |
| 2009/0025247 | A1* | 1/2009 | Yde | A45D 1/00 34/60 |

FOREIGN PATENT DOCUMENTS

| | | |
|---|---|---|
| EP | 1 433 399 A1 | 6/2004 |
| EP | 1 647 198 | 4/2006 |
| EP | 1 736 073 A1 | 12/2006 |
| FR | 2 782 614 | 3/2000 |
| FR | 2 822 351 | 9/2002 |

(Continued)

*Primary Examiner* — Emily Schmidt
*Assistant Examiner* — Lauren M Peng
(74) *Attorney, Agent, or Firm* — Polsinelli PC

(57) ABSTRACT

The applicator includes a base, a first tooth and two teeth adjacent to the first tooth. The teeth protrude from a base end located on the base as far as a free end. The applicator includes a device to retain cosmetic product on the base, to connect the first tooth to each of the two adjacent teeth, with a mean thickness less than the mean thickness, taken over the height of the device to retain, of a tooth selected from the first tooth and the two adjacent teeth.

14 Claims, 12 Drawing Sheets

(56) References Cited

FOREIGN PATENT DOCUMENTS

| | | |
|---|---|---|
| FR | 2 889 920 | 3/2007 |
| FR | 2 897 762 | 8/2007 |
| WO | 2004/032667 | 4/2004 |

* cited by examiner

COSMETIC PRODUCT APPLICATOR, ASSOCIATED HEAD AND DEVICE

CROSS-REFERENCE TO RELATED APPLICATIONS

This application claims priority under 35 U.S.C. §119(e) that claims the benefit of U.S. Provisional Application No. 61/238,708, filed Sep. 1, 2009, and claims priority under 35 U.S.C. §119 from French Application No. 09 55703, filed Aug. 18, 2009, the entire contents of each of which are herein incorporated by reference.

FIELD OF THE INVENTION

The present invention relates to a cosmetic product applicator of the type comprising:

a base;

a first tooth and two teeth adjacent to the first tooth, the teeth protruding from a base end located on the base as far as a free end;

means for retaining cosmetic product on the base.

BACKGROUND OF THE INVENTION

Discussion of Background

In the context of the present invention, the term "cosmetic product" is intended to be understood to be a product as defined in particular in the Council Directive 93/35 EC of 14 Jun. 1993.

The cosmetic product is advantageously a liquid or a cream, optionally a powder. It is intended to be applied to the skin or the keratin fibres of a human being.

There are known, for example, from FR 2 889 920, FR 2 782 614 and FR 2 822 351 devices which comprise an applicator of the above-mentioned type for dispensing a liquid colouring product on locks of hair.

The device comprises a cosmetic product application head which is mounted at the end of a receptacle which contains the product in liquid form. The head is provided with separation/combing teeth which protrude from a base in which there opens a hole for dispensing the product.

In devices of the above-mentioned type, a lock of hair to which the product must be applied is introduced between the teeth arranged on the base. Then, the lock is brushed with the cosmetic product which flows through the dispensing hole from the bottle being deposited.

Such devices allow simple application for the user. However, in order to improve the colouring result, it is sometimes necessary to apply the product in a precise and very selective manner only to selected locks without the product overflowing onto the remainder of the hair. This result is difficult to obtain since a lock is constituted by a limited number of capillary fibres which do not allow a significant amount of product to be retained through capillary action.

EP 1 736 073 describes an applicator for a hair treatment product. The applicator comprises two rows of teeth. The teeth in each row are connected to each other.

However, this applicator does not comprise a cosmetic product dispensing hole which opens via the base and which is connected to a reservoir of cosmetic product.

Furthermore, this device is not suitable for confining the product at the centre of the applicator in a very effective manner since leakages of product are likely to occur laterally between the two rows of teeth.

EP 1 433 399 describes a cosmetic product applicator which does not comprise a product dispensing hole.

FR 2 782 614 describes a device for the application of a product to the hair which comprises product dispensing holes. However, this device does not comprise means for retaining the cosmetic product removed from the device which are effective and which prevent the product from overflowing onto the remainder of the hair with a view to precise and selective application.

SUMMARY OF THE INVENTION

An object of the invention is therefore to obtain a product applicator which allows precise and selective application of the product, in particular on a selection of keratin fibres of a user, such as locks or roots.

Another object of the invention is to obtain at low cost a cosmetic product applicator which is nonetheless simple and precise to use.

To this end, the invention relates to an applicator of the above-mentioned type, characterised in that the retention means connect the first tooth to each of the two adjacent teeth, the retention means having a mean thickness less than the mean thickness, taken over the height of the retention means, of a tooth selected from the first tooth and the two adjacent teeth.

The applicator according to the invention may comprise one or more of the following features, taken in isolation or according to any technically possible combination:

- the maximum height of the retention means taken from the base is less than 0.5 times, advantageously less than 0.3 times, the maximum height of a tooth selected from the first tooth and the two adjacent teeth, taken from the base;
- the first tooth and the two adjacent teeth form a row of teeth along an alignment axis, the retention means extending substantially linearly along the alignment axis between a first adjacent tooth, the first tooth and a second adjacent tooth;
- the base ends of the first tooth and the teeth adjacent to the first tooth form the apices of a non-planar triangle, the retention means being curved between a first adjacent tooth, the first tooth and a second adjacent tooth;
- the retention means and the teeth which are connected to each other by the retention means form a partition wall which has an open contour which is advantageously concave and U-shaped, along a directing surface of the base;
- the retention means and the teeth which are connected to each other by the retention means form a partition wall having a closed contour along a directing surface of the base;
- the first tooth and the adjacent teeth form a group of peripheral teeth, no tooth extending on the base externally relative to the group of peripheral teeth;
- the retention means comprise a first partition which connects the first tooth to an adjacent tooth and a second partition which is separate from the first partition, the second partition connecting the first tooth to another adjacent tooth, the first tooth being interposed between the first partition and the second partition;
- the retention means comprise a continuous partition which connects an adjacent tooth, the first tooth and another adjacent tooth, the continuous partition being pressed on the first tooth,
- the retention means have an edge which is connected to the base and a free edge which is located remotely from the base, the retention means completely blocking over their height between the connected edge and the free edge each intermediate space located between the first tooth and each adjacent tooth, respectively;

the free edge has a concave region;

the base is elongate along a base axis which is substantially perpendicular relative to the axis of the first tooth, the retention means comprising a central partition substantially parallel with the extension axis which is arranged between two teeth and a lateral partition substantially perpendicular relative to the extension axis arranged between two teeth, the maximum height of the central partition, taken from the base, being less than the maximum height of the lateral partition, taken from the base;

the retention means have an inner face which is flush with an inner surface of the first tooth and which is advantageously flush with an inner surface of each second tooth;

the retention means have an inner face and an outer face which is inclined relative to the inner face.

The invention also relates to a head for dispensing and applying cosmetic product, of the type comprising:

a base;

a first tooth and two teeth adjacent to the first tooth, the teeth protruding from a base end located on the base as far as a free end;

a product dispensing hole which opens through the base;

means for retaining cosmetic product on the base; characterised in that the retention means connect the first tooth to each of the two adjacent teeth.

The head according to the invention may comprise one or more of the features defined above.

The invention also relates to a device for packaging, dispensing and applying cosmetic product, characterised in that it comprises:

a reservoir of cosmetic product;

a dispensing and application head as defined above, the reservoir opening through the dispensing opening.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particular since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

The invention will be better understood from a reading of the following description, given purely by way of example and with reference to the appended drawings, in which.

DETAILED DESCRIPTION OF THE PREFERRED EMBODIMENTS

Figure 1:
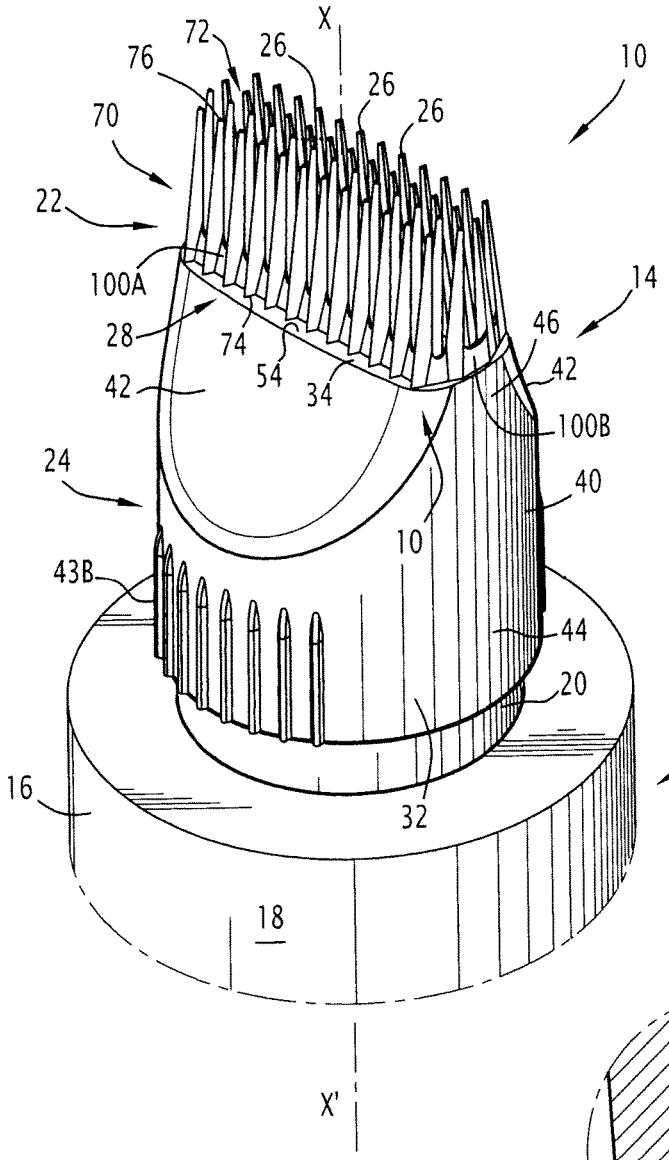
FIG. 1 is a three-quarter perspective front view of the upper portion of a first application device according to the invention.

Referring now to the drawings, like reference numerals are utilized to designate identical or corresponding parts throughout the several views.

A first device 10 for packaging, applying and dispensing a cosmetic product according to the invention is illustrated in FIGS. 1 to 7.

This device 10 is intended in particular for applying a cosmetic product in the form of a liquid, cream or optionally a powder to the keratin fibres of a user. This cosmetic product is advantageously a colouring composition for hair.

The first device 10 comprises a receptacle 12, which contains the cosmetic product, and an application and dispensing head 14 according to the invention, mounted on the receptacle 12.

The receptacle 12 is, for example, a bottle, a tube or a pocket with a base.

The receptacle 12 comprises a hollow body 16 which delimits internally a reservoir 18 of cosmetic product. It further comprises a neck 20 on which the head 14 is mounted. The neck 20 advantageously has an outer threaded portion for assembling the head 14 by means of screwing.

The application head 14 forms an applicator 22 for cosmetic product, the applicator 22 comprising a base 24, a plurality of separation/combing teeth 26 which protrude from the base 24 and, according to the invention, means 28 for retaining the cosmetic product on the base 24, arranged between teeth 26 and being defined between these teeth 26.

Figure 5:
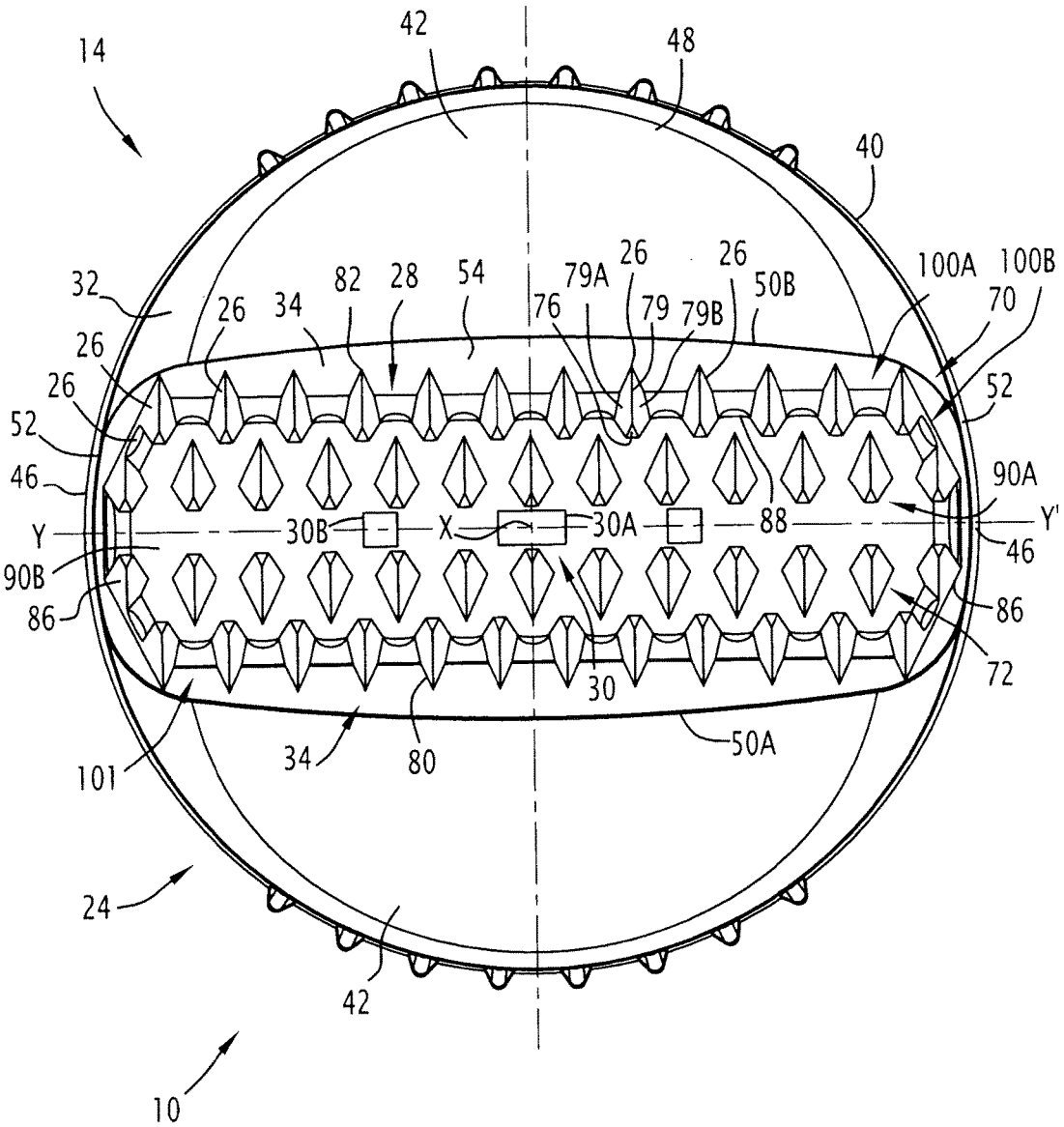
FIG. 5 is an enlarged plan view of the device of FIG. 1.

With reference to FIG. 5, the head 14 further delimits at least one product dispensing hole 30 which extends through the base 24, as will be seen below.

In this example, the application head 14 is produced in one piece, for example, by moulding a plastics or metal material.

The plastics material is, for example, polyethylene (PE), polypropylene (PP) or an elastomer material. Advantageously, the head is produced from low density polyethylene (LDPE).

Figure 2:
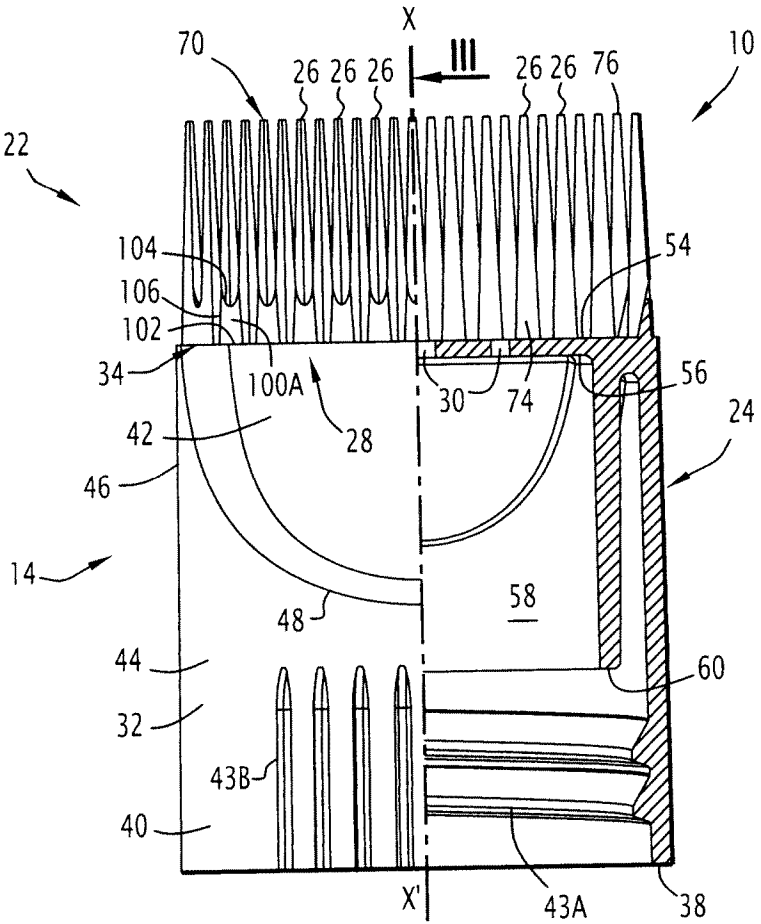
FIG. 2 is a front view, half of which is taken in section in a vertical centre plane, of the device of FIG. 1.

The base 24 comprises a peripheral skirt 32 for mounting on the neck 20, an upper plate 34 for supporting the teeth 26 and an annular locking stop 36 which can be seen in FIG. 2, the stop 36 being arranged in the skirt 32.

The skirt 32 is generally cylindrical having an axis X-X' which is illustrated so as to be vertical in FIG. 1. The axis X-X' of the skirt 32 is, for example, coaxial with the axis of the hollow body 16 on which the skirt 32 is mounted.

The skirt 32 extends along the axis X-X' between a free lower edge 38 and an upper edge which is fixedly joined to the plate 34.

In the example illustrated in FIGS. 1 to 7, the skirt 32 comprises a lower portion 40 which is substantially defined in a cylinder and two substantially planar front and rear connection portions 42 which extend at the front and the rear of the plate, respectively. The portions 42 will be referred to using the term "connection portions" in the remainder of the text.

Figure 3:
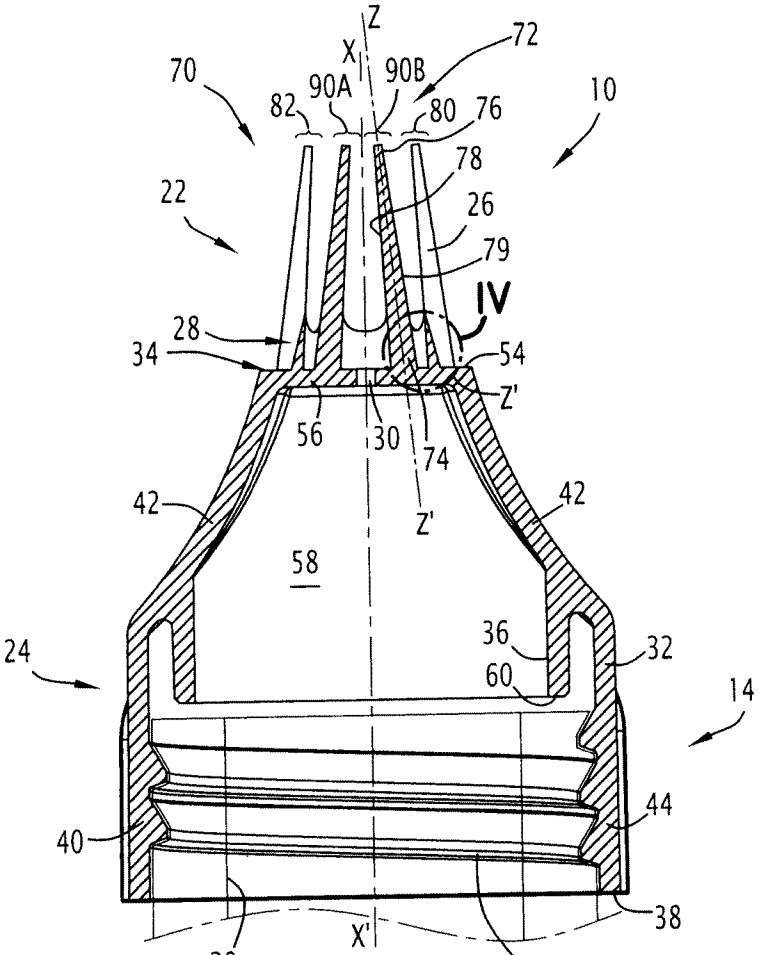
FIG. 3 is a sectional view taken in the plane III of FIG. 2.

With reference to FIGS. 2 and 3, the skirt 32 further comprises an inner threaded portion 43A which is intended to be screwed to the neck 20 and vertical outer ribs 43B for gripping in order to facilitate holding of the applicator 22 when it is being screwed.

The cylindrical portion 40 comprises a lower region 44 generated by revolution about the axis X-X' and two upper lateral extensions 46, each extension 46 being arranged between the flat portions 42 at the lateral ends of the flat portions 42.

Each extension 46 has a width which decreases in the direction moving away from the region 44 generated by revolution about the axis X-X'.

The upper extensions 46 extend as far as the plate 34 and have a width which is not equal to zero in the region of the plate 34.

Figure 6:
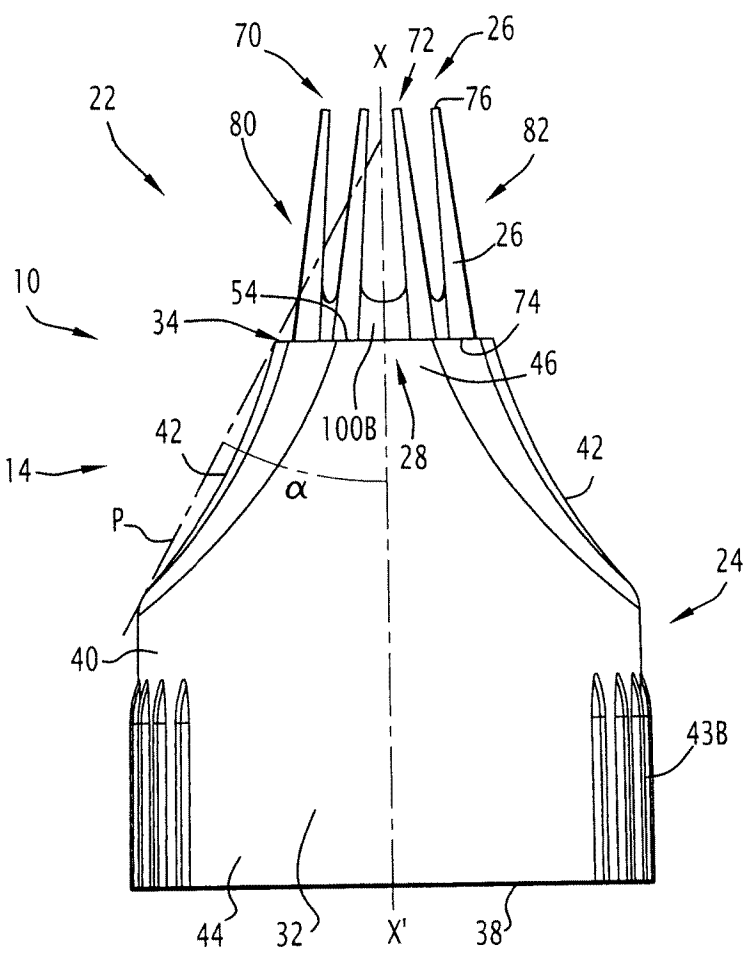
FIG. 6 is a side view of the device of FIG. 1.

The connection portions 42 are substantially located in a plane which is inclined relative to the axis X-X' through an angle $\alpha$ which can be seen in FIG. 6 between 0° and 90°, advantageously between 20° and 90°.

Each connection portion 42 has an outer surface which is slightly concave relative to the inclined plane.

The connection portions 42 are delimited downwards by a lower edge 48, which is substantially U-shaped, and upwards by the plate 34.

In the plane of the plate 34, taken perpendicularly relative to the axis X-X', the angular extent of the connection portions 42 taken about the axis X-X' is greater than the angular extent of the upper extensions 46 of the cylindrical portion 40.

The threaded portion 43A protrudes radially towards the axis X-X' from an inner surface of the cylindrical lower region 44.

The ribs 43B protrude radially away from the axis X-X' from an outer surface of the region 44. They extend below the flat portions 42.

In this example, the plate 34 extends in a plane which is generally perpendicular relative to the axis X-X'. It is delimited towards the front and rear by the flat portions 42 and laterally by the upper extensions 46.

The plate 34 advantageously has an elongate form along an axis Y-Y' which is perpendicular relative to the axis X-X' and which can be seen horizontally in FIG. 5. In a variant, the plate 34 has a circular contour.

In the example illustrated in FIG. 5, the outer contour of the plate 34 is substantially oval. It has a front edge 50A and a rear edge 50B which extend substantially parallel with the axis Y-Y' and two lateral edges 52 which extend substantially transversely relative to the axis Y-Y'.

The length of the plate 34 taken along the axis Y-Y' is substantially equal to the diameter of the cylindrical portion 40 in the lower region 44.

If the plate 34 is elongate, the maximum width of the plate 34 taken perpendicularly relative to the axis Y-Y' is less than, in particular less than 0.8 times, the maximum diameter of the cylindrical portion 40 in the lower region 44.

The plate 34 delimits an upper surface 54 for supporting the teeth and a lower surface 56 for blocking the skirt 32.

The surfaces 54, 56 extend substantially in a plane perpendicular relative to the axis X-X'.

The lower surface 56 of the plate 34 and the inner surface of the skirt 44 delimit an inner space 58 for insertion of the neck 20 and circulation of the cosmetic product which is intended to be dispensed via the head 14.

With reference to FIG. 2, the annular stop 36 protrudes away from the plate 34 into the space 58 as far as a free edge 60 which is located inside the space 58, between the free edge 38 of the skirt 32 and the plate 34. The free edge 60 is located between the lower edge 48 of the connection portions 42 and the free edge 38 of the skirt 32.

The applicator 22 comprises a first group 70 of peripheral teeth 26 which extend at the periphery of the plate 34 and a second group 72 of inner teeth 26 which extend inside the peripheral teeth.

Each tooth 26 protrudes opposite the skirt 32 from the upper surface 54 of the plate 34 between a base end 74 located on the surface 34 and a free end 76 along a tooth axis Z-Z'.

In the example illustrated in FIGS. 1 to 7, the axis Z-Z' of each tooth 26 is inclined relative to the axis X-X' which is perpendicular relative to the surface 54.

In this manner, the angle formed by the axis Z-Z' and by an axis parallel with the axis X-X' which intersects with the axis Z-Z' is greater than 0° and less than 45°.

The height of each tooth 26, taken between the free end 76 and the base end 74 along the axis X-X' is greater than 0.2 times the height of the base 24, taken along the axis X-X' between the lower free edge 38 and the plate 34. This height is between 1 mm and 20 mm.

In the example illustrated in FIG. 1, the free ends 76 of all the teeth 26 are located in the same plane parallel with the centre plane of the plate 34 perpendicularly relative to the axis X-X'.

Each tooth 26 has a polygonal cross-section, taken in the plane of the plate 34. This cross-section is advantageously in the form of a triangle which points outwards away from the axis Y-Y' so that the tooth is generally trihedral.

Figure 4:
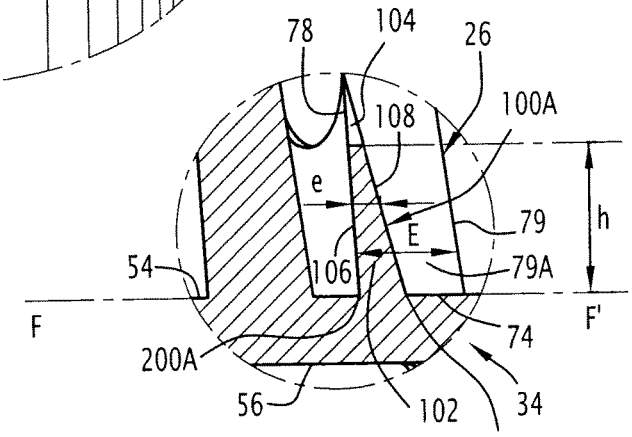
FIG. 4 is a view of a detail indicated IV in FIG. 3.

In this manner, with reference to FIGS. 4 and 5, each tooth 26 delimits a substantially planar inner surface 78 which is directed towards the axis Y-Y' and an outer edge 79 which is directed away from the axis Y-Y' and which delimits lateral surfaces 79A, 79B.

Each tooth 26 tapers in the direction moving from the base end 74 thereof towards the free end 76 thereof. In this manner, the cross-section of the tooth decreases along the axis Z-Z' of the tooth 26.

Each tooth 26 has a height which is far greater than the maximum transverse dimension thereof, for example, at least 5 times, advantageously between 5 times and 10 times, greater than the maximum transverse dimension thereof in order to retain adequate flexibility which provides the user with a sensation of flexibility.

In the region of the base end 74, each tooth 26 has a maximum width, taken parallel with the axis Y-Y' along the inner surface 78, less than the thickness thereof, taken perpendicularly relative to the axis Y-Y' between the edge 79 and the inner surface 78.

The first group of teeth 70 is formed by a first outer row 80 of teeth 26 which extends parallel with the axis Y-Y' along the front edge 50A, a second outer row 82 of teeth 26 which extends parallel with the axis Y-Y' along the rear edge 50B and two lateral lines 86 of teeth 26 which extend along the lateral edges 52.

In the example illustrated in FIG. 5, the number of teeth in the first row 80 and in the second row 82 is identical and each tooth of the first row 80 extends opposite a tooth of the second row 82.

In this example, the number of teeth 26 in each lateral line 86 is less than the number of teeth in each outer row 80, 82.

Figure 7:
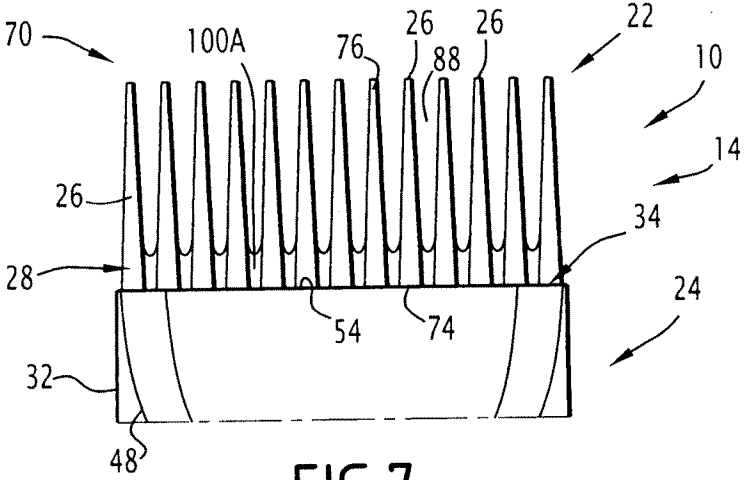
FIG. 7 is a front view of the upper portion of the applicator of the device of FIG. 1.

With reference, for example, to FIG. 7, each pair of adjacent teeth 26 of the group 70 of peripheral teeth defines, between the lateral faces 79A, 79B opposite the teeth 26, an intermediate space 88 in which the retention means 28 are arranged, as will be seen below.

The minimum width of the intermediate space 88 may be zero in the region of the plate 34. Advantageously this width is greater than 0.1 times the width of each tooth 26.

In any case, in the region of the free ends 74, the minimum width of the intermediate space 88 is greater than 0.1 times the width of each tooth 26.

This intermediate space 88 is intended to receive a selected group of keratin fibres of a lock of fibres.

The second group 72 of inner teeth comprises a first inner row 90A and a second inner row 90B which are arranged at one side and other of the axis Y-Y' parallel therewith.

The teeth 26 of the group 72 of inner teeth are axially offset along the axis Y-Y' relative to the teeth of the first outer row 80 and the second outer row 82, so as to be placed in a staggered manner.

In this manner, each tooth 26 of the second group of teeth 72 extends between two teeth 26 of the first group 70 of teeth opposite the intermediate space 88 between these teeth.

The teeth 26 of the lateral lines 86 of the group 70 of outer teeth are aligned with the first inner row 90A and the second inner row 90B, respectively.

The number of teeth in each inner row 90A, 90B may be equal to, less than or greater than the number of teeth in each outer row 80, 82.

The retention means 28 of the product connect together the teeth 26 of the group 70 of peripheral teeth.

In this manner, in the example illustrated in FIGS. 1 to 7, the retention means comprise a plurality of separate partitions which are formed by partition membranes 100A, 100B which are arranged in the intermediate spaces 88 defined between each pair of adjacent teeth 26 of the first group 70 of teeth.

The membranes 100A, 100B and the teeth 26 thus define a continuous partition wall 101 which, in the example illustrated in FIGS. 1 to 6, has a closed contour around the axis X-X' along the upper surface 54.

In a variant and as will be seen below, the partition wall 101 is formed by discontinuous portions around the axis X-X' along the upper surface 54 and at least one pair of teeth, or advantageously at least two pairs of teeth, has/have an intermediate free space 88 which has no membrane 100A, 100B.

With reference to FIGS. 2 and 4, each membrane 100A, 100B extends so as to protrude from the upper surface 54 of the plate 34 between a lower edge 102 located on the upper surface 54 and a free upper edge 104. Each membrane 100A, 100B further extends laterally as far as the lateral faces 79A, 79B opposite the two adjacent teeth 26 over a portion of the height of the teeth 26 from the base end 74.

In this manner, each partition membrane 100A, 100B blocks the intermediate space 88 over the entire width thereof between the lower edge 102 and the upper edge 104.

The height of each partition membrane 100A, 100B taken parallel with the axis X-X' between the lower edge 102 and the free upper edge 104 is less than 0.5 times, advantageously less than 0.3 times the height of each adjacent tooth 26 in order to retain good flexibility for the teeth 26, whilst ensuring adequate retention of the product on the plate 34.

Furthermore, the height of the membranes 100B located between the teeth of the lateral lines 86 is greater than the height of the partition membranes 100A located between the teeth 26 of the first outer row 80 or the second outer row 82.

For example, the height of the membranes 100B is between 0.5 and 0.2 times the height of each tooth 26, whilst the height of the membranes 100A is less than 0.2 times the height of each tooth 26.

In the example illustrated in FIG. 7, the height of the partition membranes 100A located between the teeth 26 of each row 80, 82 is substantially constant.

Furthermore, in the example illustrated in FIG. 7, each free edge 104 of a partition membrane 100A, 100B has a convex shape away from the upper surface 54.

As illustrated in FIG. 4, each membrane 100A, 100B has a maximum thickness, taken in a plane perpendicular relative to the plane defined by the two adjacent teeth 26, which is less than, advantageously 0.5 times less than, the mean thickness of each tooth 26, taken between the inner surface 78 and the edge 79 over the height of the membrane 100A, 100B.

As illustrated in FIG. 4, each membrane 100A, 100B has an inner face 106 which is flush with the inner surface 78 of the teeth and an outer face 108 which is arranged internally relative to the edge 79.

In this manner, the inner face 106 and the outer face 108 define, in projection in a plane perpendicular relative to the plane defined by two adjacent teeth 26, an angle less than the angle defined by the edge 79 and the surface 78 in the same plane.

In the same manner, the mean vertical cross-section, taken in a plane perpendicular relative to the partition membrane 100A, 100B is less than the cross-section of the tooth 26, taken over the height of the membrane 100A, 100B.

In this manner, according to the invention, at least three adjacent teeth 26 of the group of peripheral teeth 70 are connected together by the retention means 28.

The partition membranes 100A, 100B of the teeth 26 located at the corner of the first outer row 80 or the second outer row 82 and a lateral line 86 define a bent portion in the partition wall 101.

The membranes 100A of the teeth 26 located on a row 80, 82 extend linearly along an alignment axis of the teeth 26 of the row 80.

The small thickness of the membranes 100A, 100B and their small height relative to the height of the teeth 26 allow a very large degree of flexibility to be retained for the teeth 26 of the group 70 of peripheral teeth in order to maintain a tactile effect similar to that of a brush which is produced from natural hairs.

It is therefore possible to obtain an applicator 22 which has a low cost, whilst retaining good properties of use.

As illustrated in FIG. 5, the dispensing holes 30 are arranged along the axis Y-Y' between the first inner row 90A and the second inner row 90B inside the group of peripheral teeth 70.

In the example illustrated in FIG. 5, the head 14 delimits a central hole 30A having an axis X-X' and two lateral holes 30B which are spaced apart laterally at one side and the other of the central hole 30A, along the axis Y-Y'.

Each dispensing hole 30 extends through the plate 34 so as to open in the lower surface 54 and in the upper surface 56. The cross-section of the holes is adapted to the viscosity of the cosmetic product. This cross-section is less than 0.5 times, advantageously between 0.09 times and 0.3 times, the cross-section of the plate 34.

A method for applying a cosmetic product using the device 10 according to the invention will now be described.

Initially, a kit comprising a receptacle 12 containing cosmetic product and an application head 14 is provided for the user, for example, in a packaging. As has been seen above, the head 14 has been produced at low cost in a single piece by moulding plastics or metal material.

Optionally, the user prepares the product to be applied to the keratin fibres just before use. Then, he mounts the head 14 on the receptacle 12. To this end, he introduces the neck 20 into the inner space 58 and he screws the threaded portion 43A of the head 14 to the neck 20 until the neck 20 enters into contact with the lower stop 36.

A continuous product circulation space is defined from the reservoir 18 through the space 58 between the stop 36 and through the dispensing holes 30.

The user then turns over the device 10 held vertically in order to arrange it substantially horizontally or in a downwardly inclined manner. The cosmetic product contained in the reservoir 18 flows through the inner space 58 and through a hole 30 as far as the upper surface 54 of the plate 34.

The cosmetic product is distributed over the upper surface 54 between the teeth 26. The presence of the partition wall 101 defined by the membranes 100A, 100B and by the teeth 26 ensures effective retention of the product in the space defined between the teeth 26 inside the partition wall 101.

Then, the user selects a lock of keratin fibres and introduces this lock into the intermediate spaces 88 between the teeth 26, passing them perpendicularly relative to the axis Y-Y'.

The user moves the device 10 along the lock to apply cosmetic product to the keratin fibres.

The retention means 28 effectively prevent cosmetic product from escaping from the space located between the teeth 26 when cosmetic product is applied, which brings about a very localised application of cosmetic product, only on the lock selected.

Figure 8:
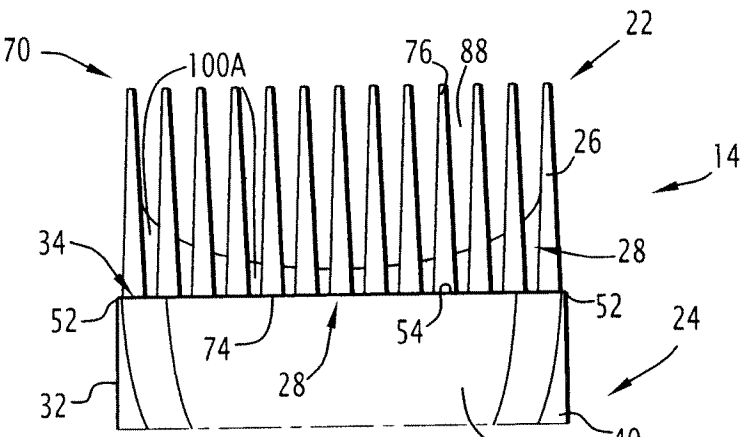
FIG. 8 is a view similar to FIG. 7 of a variant of the first device according to the invention.

The application head 14 of a variant of the first device 10 according to the invention is illustrated in FIG. 8.

In contrast to the head 14 of the first device 10, the height of the partition membranes 100A decreases in the direction along the first outer row 80 of teeth 26 and along the second outer row 82 of teeth 26 from the lateral lines 86 towards the centre of each row 80, 82. In this manner, the retention means 28 as a whole have a free edge which is substantially concave towards the centre of the head 14.

Figure 9:
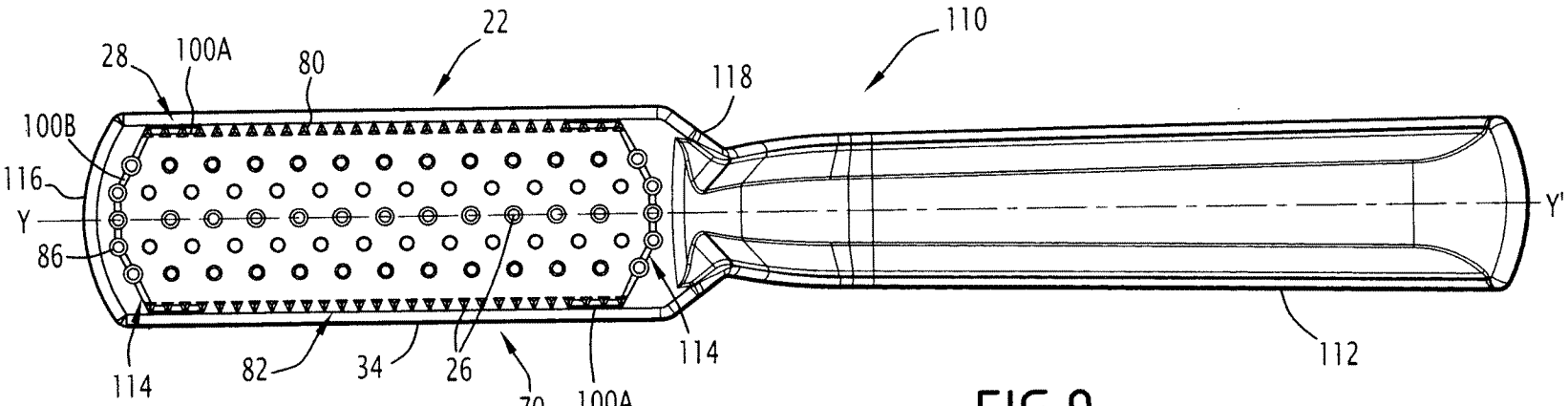
FIG. 9 is a bottom view of a second device according to the invention.
Figure 10:
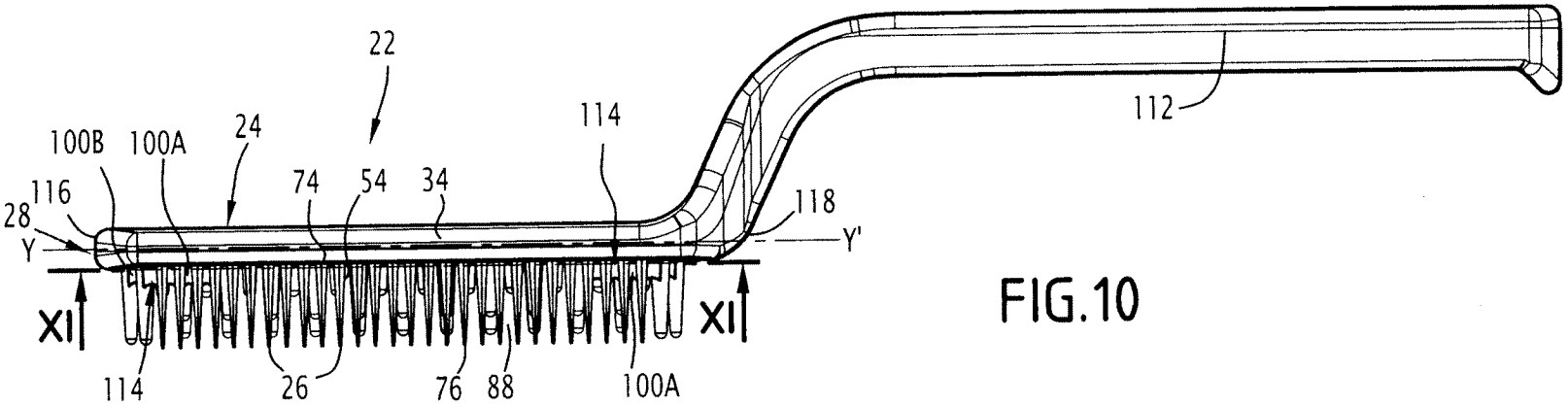
FIG. 10 is a side view of the second device according to the invention.
Figure 11:
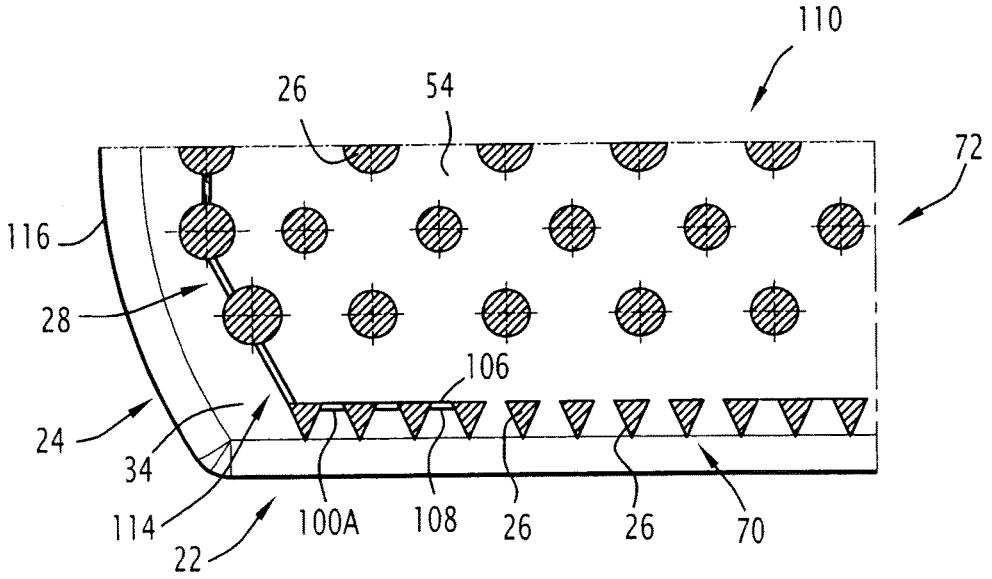
FIG. 11 is a partially sectioned view taken in the plane XI-XI of FIG. 10.

A second application device 110 according to the invention is illustrated in FIGS. 9 to 11. This second device 110 comprises an applicator 22 which has no product dispensing hole.

The second device 110 is a brush which comprises a handle 112 and the applicator 22 arranged at the distal end of the handle 112.

The applicator 22 comprises a base 24 which is formed by a plate 34 and a plurality of teeth 26 which protrude downwards from the plate.

The teeth 26 comprise a first outer row 80 of teeth 26 having a triangular cross-section and a second outer row 82 of teeth 26 having a triangular cross-section which extend along the front and rear edges of the plate 34. It further comprises a plurality of intermediate rows of teeth having a circular or oval cross-section which are arranged parallel with the extension axis Y-Y' of the plate 34.

The plate 34 is solid so it has no through-hole.

The retention means 28 comprise membranes 100A, 100B which extend between the teeth of the first outer row 80 and the second outer row 82 located in the region of a lateral line 86 and between the teeth of the two lateral lines 86.

In this manner, the retention means 28 form with the teeth 26 two partition walls 114 which are substantially U-shaped and which are located in the region of a distal edge 116 of the applicator and a proximal edge 118 of the applicator. The walls 114 have a U-shaped inwardly curved contour, taken along the surface 54. They open opposite each other, along the axis Y-Y'.

However, the adjacent teeth 26 located in a central region of the applicator 22 located between the wall portions 114 in the outer rows 80, 82 are not connected to each other by the retention means 28. In this manner, the intermediate space 88 between these teeth 26 is completely open and has no retention means 28 in order to allow keratin fibres to pass through without any obstruction.

In order to use the second device 110, a quantity of cosmetic product is arranged on the plate 34, with the plate 34 being turned over so that the teeth 26 protrude upwards. Then, the user grips the handle 112 and brushes the keratin fibres in order to pass them between the teeth 26 perpendicularly relative to the axis Y-Y'.

Figure 13:
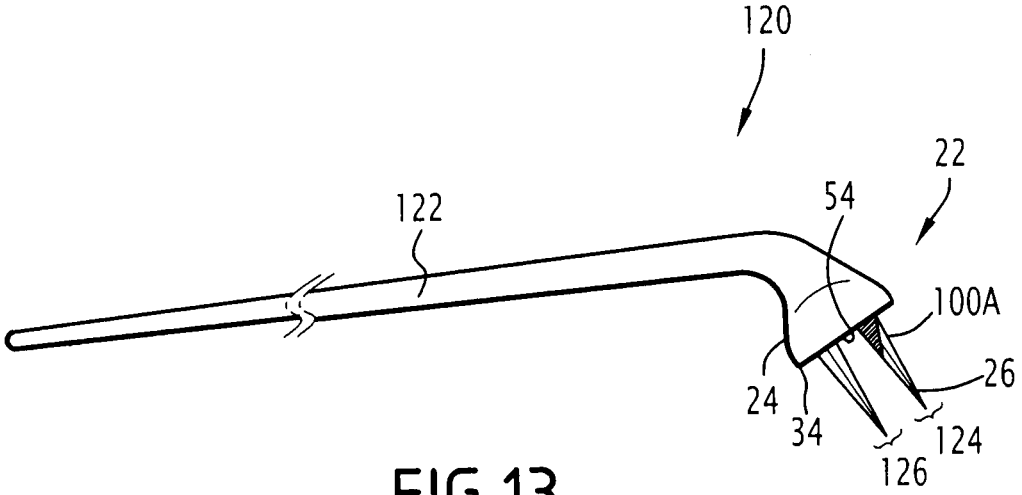
FIG. 13 is a side view of the third device according to the invention.
Figure 14:
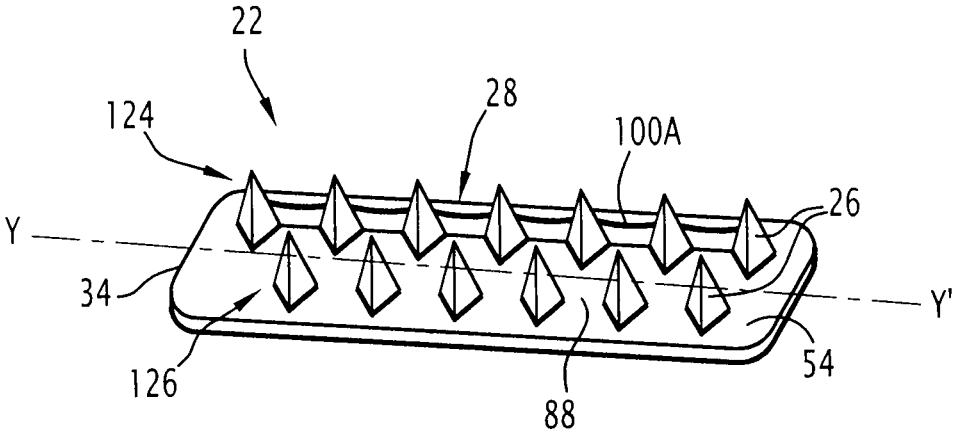
FIG. 14 is a detailed view of the applicator of the third device according to the invention.

A third device 120 according to the invention is illustrated in FIGS. 13 to 14. As illustrated in these Figures, the third device 120 forms an applicator brush which is intended for the application of a cosmetic product to the keratin fibres of a user.

Such a brush is intended to be used in particular to apply a colouring and/or bleaching composition to the keratin fibres of a user.

Figure 12:
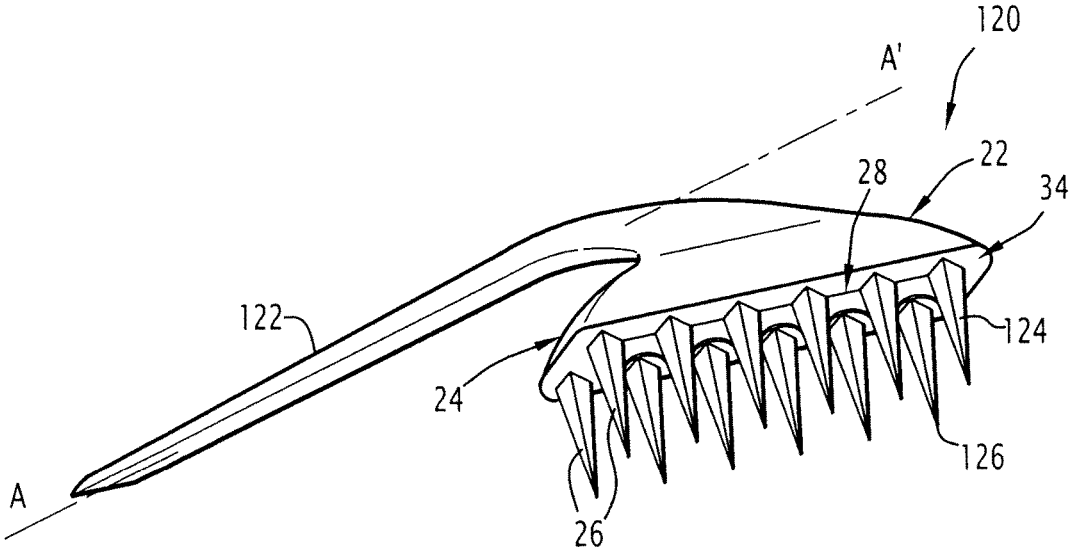
FIG. 12 is a perspective view of a third device according to the invention.

As illustrated in FIG. 12, this brush comprises a handle 122 having a cross-section less than that of the applicator 22. The applicator 22 is integral with the handle 122 and is arranged at a distal end of the sleeve 122.

The base 24 of the applicator has a shape which widens perpendicularly relative to the axis A-A' of the handle 122. The outer support surface 54 of the teeth 26 extends in an inclined plane relative to the axis A-A' of the handle.

The applicator 22 advantageously comprises a first row 124 of teeth 26 which are connected to each other by the retention means 28 and a second row 126 of teeth parallel with the first row 124 in which the intermediate space 88 between the teeth 26 is free.

As illustrated in FIG. 14 which illustrates the plate 34 of the base 24, the teeth 26 of the second row 126 are spaced-apart longitudinally along the extension axis Y-Y' of the plate 34 relative to the teeth 26 of the first row 124 so as to be arranged in a staggered manner.

The membranes 100A are aligned with each other to form with the teeth 26 of the first row 124 a continuous wall which extends linearly parallel with the axis Y-Y' of the base 24.

In order to use the third device 120, the user dips the applicator 22 into cosmetic product and then passes the keratin fibres between the teeth 26 perpendicularly relative to the axis Y-Y'.

The membranes 100A placed at one side of the applicator 22 increase the recovery of the product in the product receptacle and allows the product to be spread more effectively on the fibres.

Figure 15:
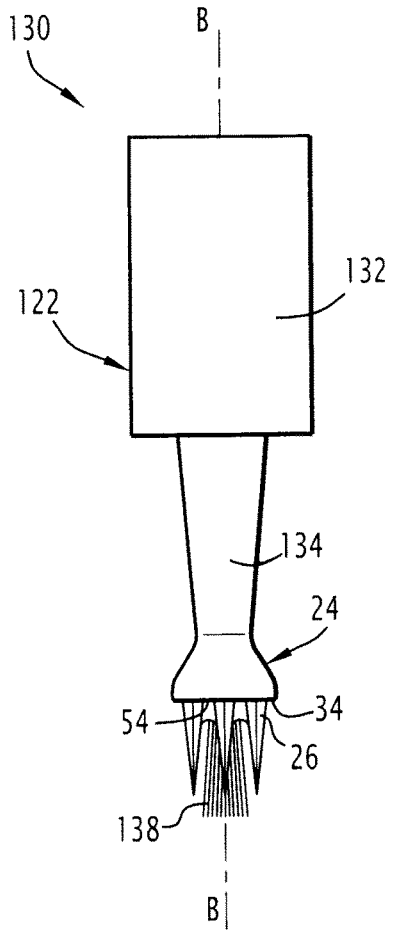
FIG. 15 is a front view of a fourth device according to the invention.
Figure 16:
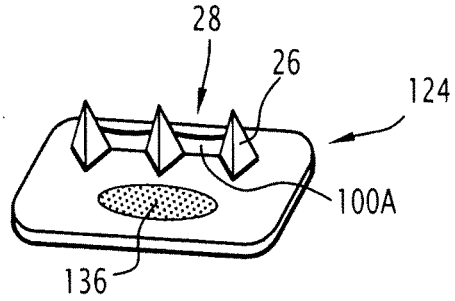
FIG. 16 is a view similar to FIG. 14 of the fourth device according to the invention.
Figure 17:
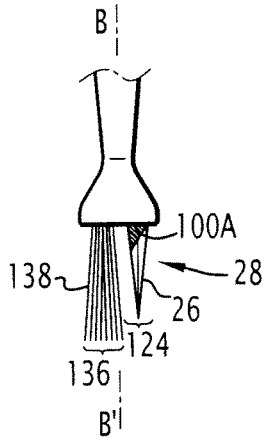
FIG. 17 is a side view of the applicator of the fourth device according to the invention.

A third device 130 according to the invention is illustrated in FIGS. 15 to 17. This device 130 is intended in particular to form an applicator brush, for example, for a product which is intended to be applied to the nails, such as a nail varnish.

In contrast to the second device 120 illustrated in FIGS. 12 to 14, the applicator 22 extends in the axial extension of the handle 122, the plate 34 being perpendicular relative to the axis B-B' of the handle 122. The handle 122 thus comprises a gripper 132 and a shank 134 having a diameter less than that of the gripper 132. The applicator 22 is mounted at the distal end of the shank 134.

In contrast to the third device 120, the applicator 22 of the fourth device 130 comprises a single row 124 of teeth 26. The second row of teeth is replaced by a bristled zone 136 which is arranged parallel with the row 124 of teeth 26 at the rear of the teeth 26.

The partition means 28 are arranged between the teeth of the row 126 and are formed by membranes 100A as described above.

The bristled zone 136 comprises a plurality of natural or synthetic bristles 138 which protrude from the outer abutment surface 54 in parallel with the teeth 26.

The bristles 138 have a maximum cross-section, taken perpendicularly relative to the axis B-B' which is less than the maximum cross-section of the teeth 26, advantageously at least three times less than this cross-section.

In order to use the fourth device 130, the user dips the applicator 22 into liquid cosmetic product and applies this product to the nails using the bristles and the teeth.

Figure 18:
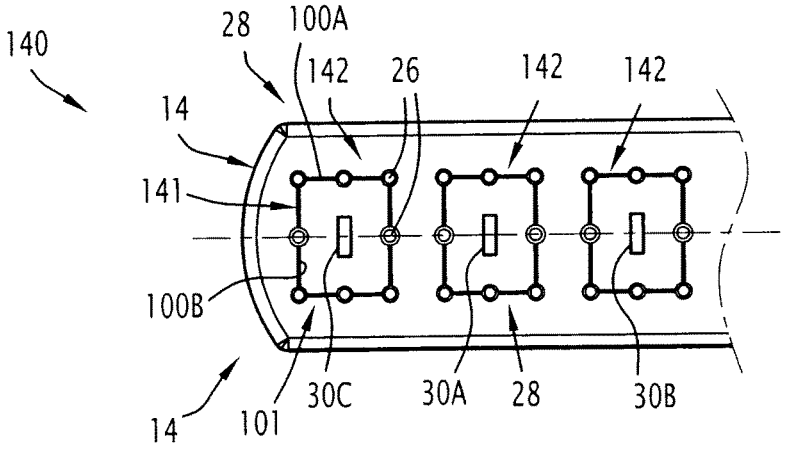
FIG. 18 is a bottom view of the applicator of a fifth device according to the invention.

The application head 14 of a fifth device 140 according to the invention is partially illustrated in FIG. 18.

In contrast to the first device 10, each dispensing hole 30A, 30B, 30C is surrounded by a continuous partition wall 101 defined between a group 142 of peripheral teeth which are distributed angularly around each hole 30A, 30B, 30C. As in the example illustrated in FIG. 1, each partition wall 101 is formed by the membranes 100A, 100B which are arranged in the intermediate spaces 88 as described above.

The fifth device 140 advantageously comprises a plurality of reservoirs (not illustrated) which contain separate cosmetic products, respectively, each reservoir being connected to a respective hole 30A, 30B, 30C.

The separate cosmetic products may have in particular different colours.

In this manner, it is possible to apply in parallel a plurality of separate cosmetic products to groups of parallel keratin fibres of a lock of hair, passing these groups opposite each hole 30A, 30B, 30C between the teeth 26 of the group of peripheral teeth 142 which surrounds each hole 30A, 30B, 30C, respectively.

Figure 19:
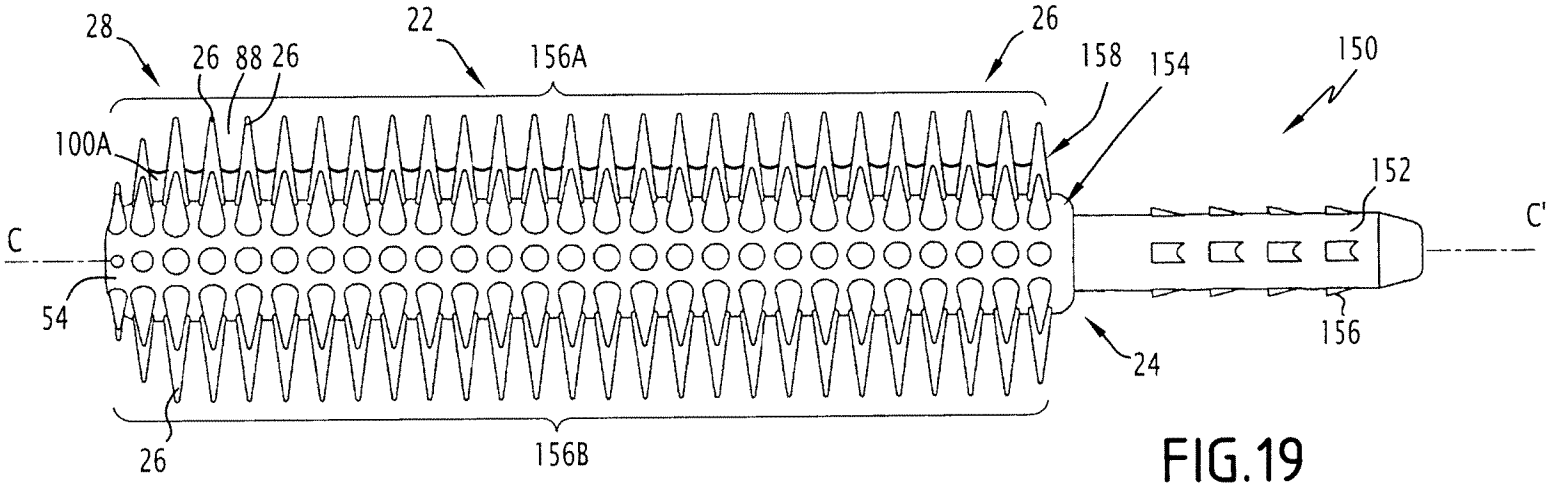
FIG. 19 is a side view of the applicator of a sixth device according to the invention.

The applicator 22 of a sixth device 150 according to the invention is illustrated in FIG. 19.

The sixth device 150 is intended in particular to apply a cosmetic product to the eyelashes of a user, advantageously a cosmetic make-up product.

The base 24 of the applicator 22 comprises a shank 152 for fixing to a handle (not illustrated) and a cylindrical core 154 which carries the teeth 26.

The shank 152 and the core 154 extend along a longitudinal axis C-C'.

The shank 152 is intended to be mounted in the handle to facilitate handling of the applicator 22 by the user. To this end, the shank 152 is provided with pins 156 for force-fitting which protrude radially away from the axis C-C'.

The core 154 has a transverse dimension greater than that of the shank 152. It defines a substantially cylindrical outer surface 54 for abutment of the teeth having an axis C-C'.

The applicator 22 has a plurality of longitudinal rows 156A, 156B of teeth 26, the teeth 26 of each row 156A, 156B being arranged in a regular manner along a generating line which defines the surface 54.

In the example illustrated in FIG. 19, each tooth 26 of a row 156A is located on the same circumference about the axis C-C' as a tooth of another row 156B.

The partition means 28 comprise a plurality of membranes 100A which have a substantially constant height and which are interposed in the intermediate space 88 between two teeth 26 of a row 156A.

The membranes 100A extend along a generating line of the surface 54 to define with the teeth 26 of the row 156A a substantially linear partition wall 158 which extends over substantially the entire length of the core 54.

The other rows of teeth 156B spaced angularly apart from the first row 156A have no retention means 28 so that the intermediate space 88 between the teeth 26 of the rows 156B is open.

The presence of the partition wall 158 allows retention of the cosmetic product after it has been immersed in the make-up fluid during the application by passing the eyelashes of the user between the teeth of each row 156A, 156B transversely relative to the axis C-C'.

Figure 20:
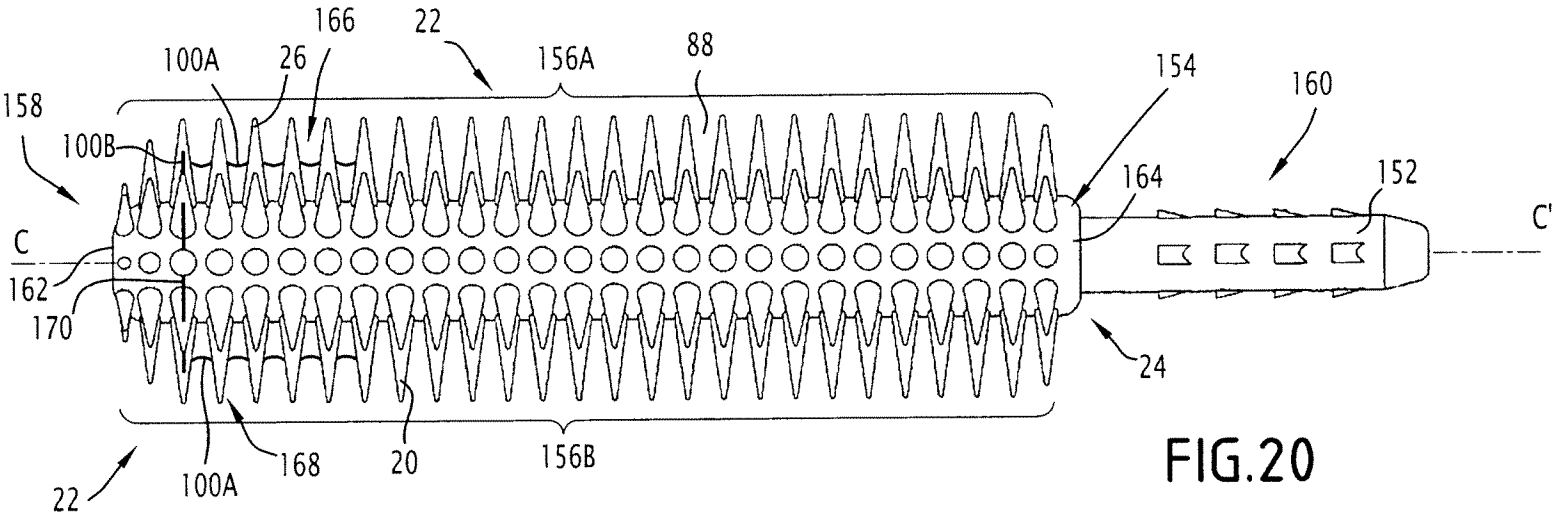
FIG. 20 is a view similar to FIG. 19 of a seventh device according to the invention.

The applicator 22 of a seventh device 160 according to the invention is illustrated in FIG. 20.

In contrast to the applicator 22 of the sixth device 150, the partition wall 158 is substantially U-shaped, closed in the region of the distal end 162 of the core 154 and opens towards the proximal end 164 of the core 154. It thus comprises a first longitudinal portion 166 which is formed by membranes 100A which are arranged between a group of distal teeth of the first row 156A, a second longitudinal portion 168 which is angularly spaced-apart relative to the first longitudinal portion 166.

The second longitudinal portion 168 is formed by membranes 100A which are located between the teeth of a distal group of teeth 26 of the second row 156B.

The partition wall 158 further comprises a circumferential intermediate portion 170 formed by membranes 100B which distally connect the first longitudinal portion 166 to the second longitudinal portion 168.

The intermediate portion 170 is formed by membranes 100B which extend between the teeth 26 located on the same circumference around the axis C-C' between the first row 156A and the second row 156B.

The teeth 26 of the first row 156A and the second row 156B located between the first longitudinal portion 166 and the proximal end 164 and between the second longitudinal portion 168 and the proximal end 164 respectively have no retention means 28 so that the intermediate space 88 located between these teeth 26 is free.

The length of the longitudinal portions 166, 168 taken parallel with the axis C-C' is less than 0.5 times the length of the core 154 taken between the proximal end 162 and the distal end 164.

The wall 158 forms with the core 154 a receptacle which is capable of retaining cosmetic product when it is immersed in the fluid.

Figure 21:
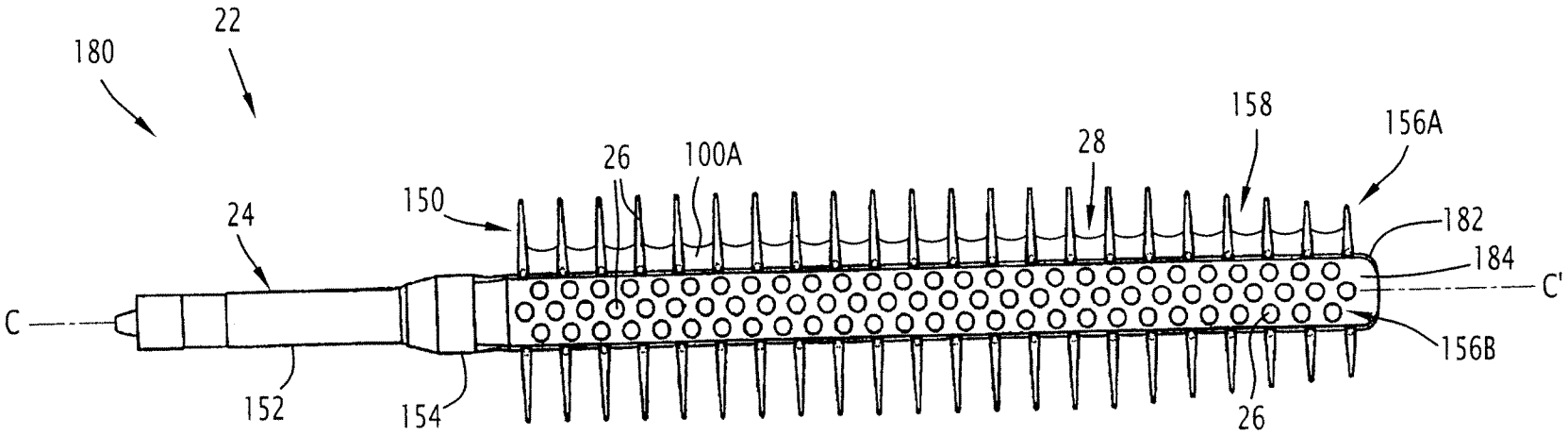
FIG. 21 is a side view of the applicator of an eighth device according to the invention.

An eighth device 180 according to the invention is illustrated in FIG. 21. In contrast to the sixth device, the core 154 has a cross-section which is polygonal, advantageously rectangular or square.

The core 154 thus delimits a first lateral face 182 which comprises a plurality of parallel rows of teeth 156A and a second lateral face 184 perpendicular relative to the first lateral face 182 which comprises a plurality of rows of teeth 156B which are arranged in a staggered manner relative to the teeth 26 of each first row 156A.

The retention means 28 comprise at least one longitudinal partition wall 158 which extends along the entire length of a row 156A, as described for the sixth device 150.

Figure 22:
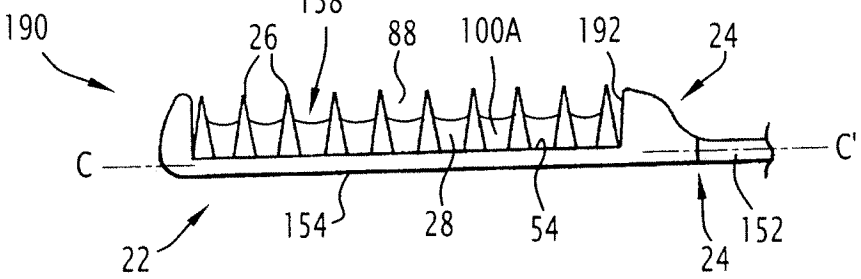
FIG. 22 is a view similar to FIG. 19 of a ninth device according to the invention.

The applicator 22 of a ninth device 190 according to the invention is illustrated in FIG. 22.

The base 24 of the applicator 22 is formed by a substantially cylindrical core 154 which delimits a longitudinal recess 192 substantially over the entire length thereof. The recess 192 has a base which is delimited by a planar base surface 54.

The applicator 22 further comprises a row 156A of teeth 26 which is arranged in the recess 192 and which protrudes from the base surface 54 of the recess 192. The teeth 26 have a height, taken perpendicularly relative to the axis C-C' of the core 154, which is substantially equal to the depth of the recess 192.

The retention means 28 comprise a plurality of membranes 100A which are arranged in the intermediate spaces 88 between each pair of teeth of the row 156A to form a longitudinal partition wall 158.

Figure 23:
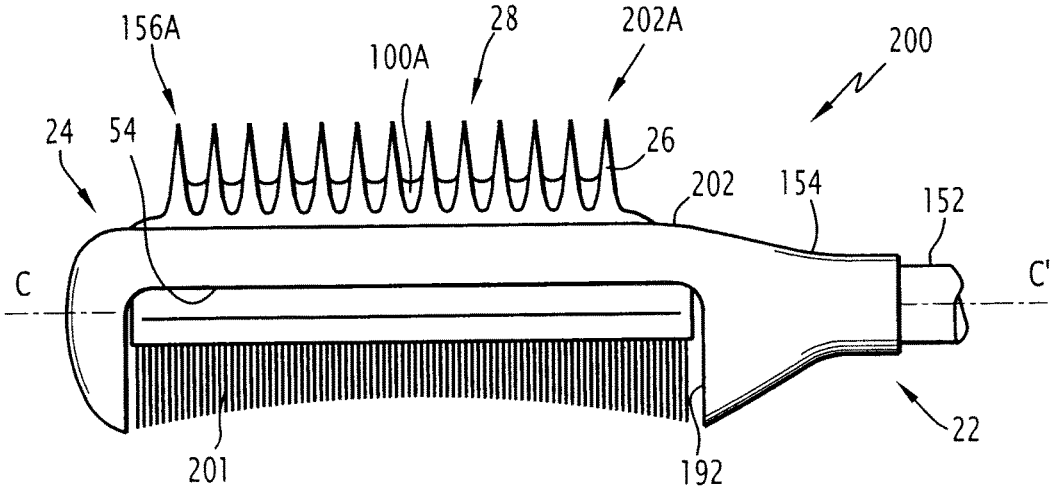
FIG. 23 is a view similar to FIG. 19 of a tenth device according to the invention.

An eleventh device 200 according to the invention is illustrated in FIG. 23. In contrast to the tenth device 190, a comb 201 formed by bristles is arranged in the recess 192. A row 156A of teeth 26 is arranged on an outer surface 202 of the core located opposite the base surface 54 of the recess 192.

The row 156A extends linearly parallel with the longitudinal axis C-C' of the core 154. The retention means 28 comprise a plurality of membranes 100A which are arranged between the teeth 26 of the row 156A, as described above, in order to define a linear partition wall 158 with the teeth 26.

Figure 24:
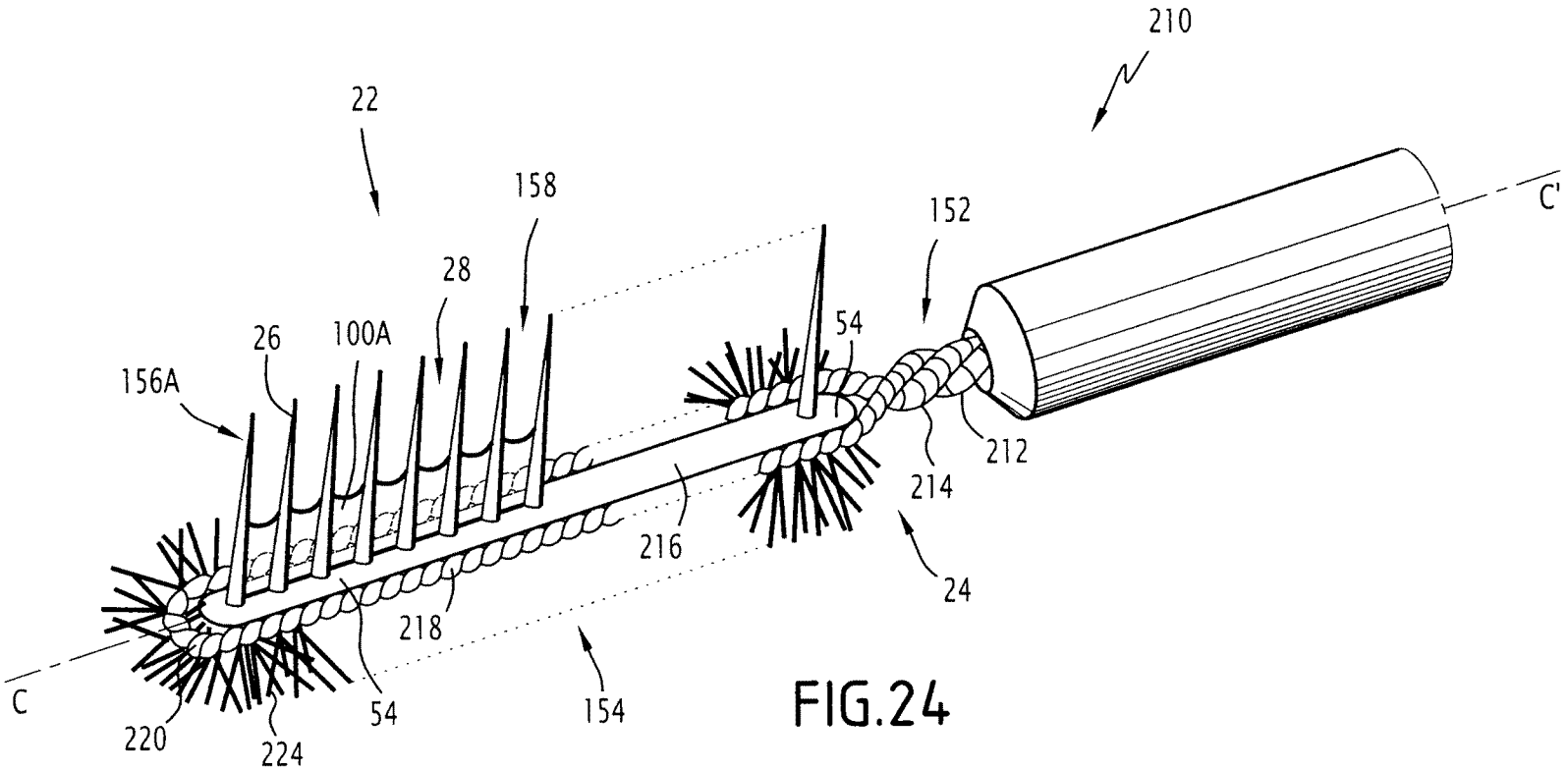
FIG. 24 is a partial three-quarter perspective front view of an eleventh device according to the invention.

The applicator 22 of a twelfth device 210 according to the invention is illustrated in FIG. 24.

In contrast to the applicator 22 of the sixth device, the base 24 comprises a shank 152 which is formed by a coil of twisted wires 212, 214 and a core 154 comprising a longitudinal body 216 which is surrounded by a continuation 218 in the form of a loop of the wires 214, 212 which are connected to each other at the distal end 220 of the applicator 22.

The body 216 defines an outer surface 54 for abutment of a first row 156A of teeth 26. The first row 156A extends longitudinally along the axis C-C' of the core 154.

The teeth 26 of the first row 156A are connected to each other by the retention means 28 which are formed by membranes 100A as described above.

The membranes 100A and the teeth 28 form, as described above, a partition wall 158.

The extension of the threads 220 carries a plurality of bristles 224 which protrude radially away from the axis C-C' opposite the teeth 26.

Figure 25:
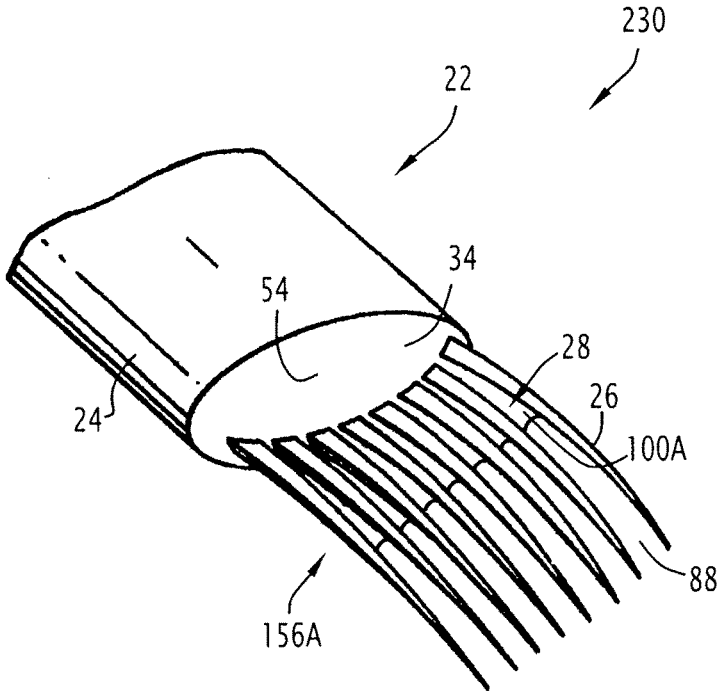
FIG. 25 is a partial three-quarter perspective front view of a twelfth device according to the invention.

The applicator 22 of a thirteenth device 230 according to the invention is illustrated in FIG. 25.

The applicator 22 is intended to form a comb for application of a make-up composition. In contrast to the applicator 22 of the first device 10, the base 24 has a solid upper plate 34, that is to say, without any through-holes for dispensing the product.

The applicator 22 comprises a first row 156A of teeth 26 which protrude away from the plate 34, curving slightly inwards.

The first row 156A extends along an inwardly curved line on the abutment surface 54.

The retention means 28 comprise membranes 100A, as described above, which connect the teeth 26 of the row 156A together in the intermediate space 88 defined between each pair of teeth 26.

In the present application, the terms "one", "two", "three", etc., are intended to be understood as "at least one", "at least two", "at least three", etc., unless stated otherwise.

As has been seen above, the retention means 28 formed by the intermediate partitions between the teeth 26 and the teeth 26 connected together by the retention means 28 advantageously form a partition wall 101 which has a substantially U-shaped concave contour or a closed contour along the upper surface 54 of the base 24.

In this instance, the retention of the product is particularly effective, in particular since it allows the product to be concentrated and retained at the centre of the upper surface 54 defined by the plate 34 of the base 24. In this manner, the product extracted through the dispensing hole 30 is concentrated in the region located opposite the plate 34 and does not have a tendency to flow laterally from the plate 34.

The application of the cosmetic product to the lock of hair received between the teeth 26 is very precise and the risk of colouring another lock is found to be significantly reduced.

As has been seen above, there is provision for the retention means 28 to connect together the teeth 26 of a group 70 of teeth. In this manner, the retention means 28 are formed, for example, by separate partitions which are arranged in the intermediate spaces 88 defined between each pair of adjacent teeth 26 of the group of teeth 26. These partitions may advantageously be membranes 100A, 100B owing to their small thickness.

In this regard, as illustrated in FIG. 4, the mean thickness of the retention means 28 is measured as the arithmetic mean of the thicknesses e taken in a median plane perpendicular relative to the centre plane P defined by two adjacent teeth 26 parallel with the axis F-F' passing via the intersection points 200A, 200B between the base 34 and the inner face 106 and outer face 108 of the partition which forms the retention means 28, respectively. The mean is taken over the height h of the retention means 28 in the plane P.

The mean thickness of the tooth 26 is measured as the arithmetic mean of the thicknesses E taken parallel with the same axis F-F' between the inner surface 78 and the outer surface 79 over the height of the partition means 28 in projection in the plane P.

It can further consequently be seen, from the description above, in the devices according to the invention, that at least a first tooth 26 is connected to an adjacent tooth 26 via a first partition membrane 100A and to another adjacent tooth 26 via a second partition membrane 100B forming discontinuous partitions which are separated from each other by the first tooth 26, or a continuous partition which has an intermediate portion which is pressed onto the first tooth 26.

Furthermore, when the first tooth 26 is located at the intersection between a first row 80 of teeth 26 which extends along a first axis and a second line 86 of teeth which extends along a second axis intersecting with the first axis, as can be seen, for example, in FIG. 5, or in FIG. 9, the retention means 28, the first tooth 26, and the adjacent teeth 26 form a partition wall having an inwardly curved or bent contour in the region of the first tooth, following the upper surface 56 of the plate 24.

In this manner, the base ends of the first tooth 26, located at the intersection between the row 80 and the line 86, and the base ends of the two teeth 26 adjacent to the first tooth 26 form the apices of a non-planar triangle.

Furthermore, it should be understood from the above description that the terms "inner" and "outer" are intended to be understood in a relative manner in relation to the centre of the plate 34 which carries the teeth 26, the term "inner" generally being understood to be closer to the centre or directed towards the centre in relative terms, and the term "outer" to be relatively more remote from the centre or directed away from the centre.

In this manner, the inner face 106 of the retention means 28 is directed towards the centre of the plate 34, whilst the outer face 108 is directed towards the periphery of the plate 34.

Obviously, numerous modifications and variations of the present invention are possible in light of the above teachings. It is therefore to be understood that within the scope of the appended claims, the invention may be practiced otherwise than as specifically described therein.

The invention claimed is:

1. A head for dispensing and applying cosmetic product, comprising:

a base; wherein the base comprises an upper plate;

a first tooth having a base end;

two teeth adjacent to the first tooth, each of the two teeth protruding from a base end located on the base as far as a free end located away from the upper plate;

a product dispensing hole which opens through an upper surface of the upper plate, the product dispensing hole extending through the upper plate;

a retainer for the cosmetic product on the upper plate, wherein the retainer connects the first tooth to each of the two adjacent teeth, the retainer and teeth are connected to each other by the retainer forming a partition wall having a closed contour along a directing surface of the base, wherein the partition wall protrudes from the upper surface of the upper plate beyond the dispensing hole; and wherein the base comprises a lower passage for introducing a neck of a container;

the product dispensing hole is in fluidic communication with the lower introduction passage to allow the dispensing of product and opens downwardly in a lower surface of the base and towards the introduction passage;

the product dispensing hole is permanently open; and the retainer partition wall protrudes beyond the dispensing hole from the upper surface of the upper plate over the whole closed contour along a directing surface of the base.

2. The head according to claim 1, wherein the retainer has a mean thickness less than a mean thickness, taken over a height of the retainer, of a tooth selected from the first tooth and the two adjacent teeth.

3. The head according to claim 1, wherein a maximum height of the retainer taken from the base is less than 0.5 times a maximum height of a tooth selected from the first tooth and the two adjacent teeth, taken from the base.

4. The head according to claim 1, wherein the first tooth and the two adjacent teeth form a row of teeth along an alignment axis, the retainer extending substantially linearly along the alignment axis between said first adjacent tooth, the first tooth and said second adjacent tooth.

5. The head according to claim 1, wherein the base ends of the first tooth and the teeth adjacent to the first tooth form apices of a triangle, the retainer being curved between said first adjacent tooth, the first tooth and said second adjacent tooth.

6. The head according to claim 1, wherein the first tooth and the adjacent teeth form a group of peripheral teeth, with no tooth extending on the base externally relative to the group of peripheral teeth.

7. The head according to claim 1, wherein the partition wall is further defined by a first partition which connects the first tooth to one of the adjacent teeth and a second partition which is separate from the first partition, the second partition connecting the first tooth to another of the adjacent tooth, the first tooth being interposed between the first partition and the second partition.

8. The head according to claim 1, wherein the partition wall is further defined by a continuous partition which connects an adjacent tooth, the first tooth and another adjacent tooth, the continuous partition being pressed on the first tooth.

9. The head according to claim 1, having intermediate space between the first tooth and each adjacent tooth and wherein the retainer has an edge which is connected to the base and a free edge which is located remotely from the base, the retainer completely blocking over their height between the connected edge and the free edge, each of the intermediate space located between the first tooth and each adjacent tooth, respectively.

10. The head according to claim 9, wherein the free edge has a concave region.

11. The head according to claim 1, wherein the base is elongate along a base extension axis (Y-Y') which is substantially perpendicular relative to an axis (Z-Z') of the first tooth, the retainer including a central partition substantially parallel with the extension axis (Y-Y') which is arranged between two teeth and a lateral partition substantially perpendicular relative to the extension axis (Y-Y') arranged between two teeth, the maximum height of the central partition, taken from the base, being less than the maximum height of the lateral partition, taken from the base.

12. The head according to claim 1, wherein the retainer has an inner face which is flush with an inner surface of the first tooth and which is advantageously flush with an inner surface of each second tooth.

13. A device for packaging, dispensing and applying cosmetic product, comprising: a reservoir configured to contain cosmetic product; a dispensing and application head according to claim 1, wherein the reservoir is configured to open through the dispensing opening.

14. A head for dispensing and applying cosmetic product comprising:

a base wherein the base comprises an upper plate:

a first tooth having a base end two teeth adjacent to the first tooth, each of the teeth protruding from a base end located on the base as far as a free end located away from the base;

a product dispensing hole which opens through an upper surface of the upper plate of the base, the product dispensing hole extending through the upper plate;

a retainer for the cosmetic product on the base;

wherein the retainer connects the first tooth to each of the two adjacent teeth;

and wherein the retainer comprises intermediate spaces between each pair of adjacent teeth, an a partition wall between each pair of adjacent teeth, the partition wall having a free edge which has a concave shape away from the upper surface in a direction from one tooth to the adjacent tooth, a height of the partition wall being lower at half distance between the teeth in comparison with the height of the partition wall in contact with each of the teeth.

* * * * *